US005934030A

United States Patent [19]

McDonald

[11] Patent Number: 5,934,030

[45] Date of Patent: Aug. 10, 1999

[54] DOOR FRAME

[75] Inventor: Harley C. McDonald, Omaha, Nebr.

[73] Assignee: Composite Structures, Inc., Omaha, Nebr.

[21] Appl. No.: 08/921,157

[22] Filed: Aug. 29, 1997

[51] Int. Cl.[6] ..... E06B 1/26; E06B 1/52

[52] U.S. Cl. ..... 52/204.1; 52/212; 52/216; 52/217; 52/309.2; 52/656.4; 52/737.2; 49/505

[58] Field of Search ..... 52/204.1, 212, 52/216, 217, 309.2, 656.4, 737.2, 737.3; 49/504, 505

[56] References Cited

U.S. PATENT DOCUMENTS

D. 262,404 12/1981 Bittner .
D. 305,366 1/1990 Ripley .
D. 305,367 1/1990 Ripley .
3,778,945 12/1973 Medow ..... 52/217
4,330,972 5/1982 Sailor .
4,588,235 5/1986 Barroero .
5,030,662 7/1991 Banerjie .
5,070,651 12/1991 Jeter .
5,187,898 2/1993 McKann .
5,228,240 7/1993 Barroero et al. .
5,255,971 10/1993 Aisley .
5,345,722 9/1994 McKann .
5,406,768 4/1995 Giuseppe et al. .
5,412,909 5/1995 Wu .
5,584,157 12/1996 Sun ..... 52/656.4

*Primary Examiner*—Christopher T. Kent
*Attorney, Agent, or Firm*—Zarley, McKee, Thomte, Voorhees & Sease; Dennis L. Thomte

[57] ABSTRACT

A door frame including of first and second door frame members is provided wherein each of the first and second door frame members is of unitary molded fiberglass construction. Each of the first and second door frame members including side jambs having a head jamb extending therebetween. Each of the first and second door frame members includes a trim section which overlies a wall surface of the wall extending around the door opening and includes an inside section extending substantially perpendicularly from the trim section. The inside surface of one of the door frame members may be trimmed for reception in a recess formed in the other frame member so that the frame members will accommodate walls of various thicknesses. A door of fiberglass construction is hingedly secured to one of the door frame members.

19 Claims, 4 Drawing Sheets

DOOR FRAME

BACKGROUND OF THE INVENTION

1. Field of the Invention

This invention relates to a door frame and more particularly to a door frame comprised of two unitary door frame members.

2. Description of the Related Art

Door frames traditionally include a pair of vertically disposed side jambs and a head jamb extending across the upper ends of the side jambs. One of the side jambs is usually termed a hinge jamb while the other side jamb is usually termed a latch jamb. The door frame is normally positioned in a door opening formed in a wall surface. Vertical and horizontal trim members are then positioned at the opposite sides of the door frame to cover the gap between the door frame and the door opening. Traditionally, these door frame members are made of wood, aluminum, steel, plastic and/or fiberglass. The members are normally fabricated/manufactured from boards, bent steel plates, extruded aluminum, extruded plastic and/or pultruded fiberglass. All of these methods of manufacture produce straight structural members which must be joined at their junctures. Necessarily, because of the above-described construction of the door frame, joints are present between the side jambs and head jamb, as well as miter joints being present between the vertical and horizontal trim members. Additionally, joints are formed at the juncture of the trim members and the jambs. A wood door is normally hingedly secured to the hinge jamb. The door frame may be sold as a pre-hung door assembly or the door may be installed in the door frame after the door frame has been installed in the door opening.

If the door frame described above is used in a food or meat processing plant, the joints therein present a space in which bacteria may grow and which makes cleaning thereof difficult. Inasmuch as food and meat processing plants are frequently washed or cleaned with corrosive chemicals, the steel door frames and doors secured thereto rapidly deteriorate. However, even stainless steel side jambs and head jambs still have joints therebetween unless the joints are welded and ground smooth. Usually, these joints are the weakest points in the frame and can separate or cause difficulty during installation and, in some cases, open or separate after installation. Further, if separate steel trim members are used, miter joints exist between the vertical and horizontal trim members. Additionally, since wall thicknesses vary, it is necessary to fabricate door frames of varying sizes to accommodate the same.

SUMMARY OF THE INVENTION

A door frame comprised of first and second door frame members constructed of a fiberglass material. The first door frame member includes a first side jamb, a second side jamb, and a first head jamb extending between the upper ends of the first and second side jambs. The first door frame member includes a trim section for overlying a first wall surface adjacent a door opening in a wall and further includes an inside section which extends substantially perpendicularly from the trim section for extending into the door opening. The second door frame member includes a first side jamb, a second side jamb, and a first head jamb extending between the upper ends of the first and second side jambs of the second door frame member. The second door frame member includes a trim section for overlying a second wall surface adjacent the door opening and further includes an inside section extending substantially perpendicularly from the trim section for extending into the doorway opening. Each of the first and second door frame members are of unitary construction. When the first and second door frame members are installed in the door opening, one of the door frame members is received by a recessed portion in the other door frame member. The two frame members are then connected together by mounting screws and/or adhesive to form a unitary frame. A fiberglass door is hingedly secured to one of the side jambs of one of the door frame members. The door frame member upon which the door is hingedly mounted is provided with an integrally formed door stop member. The hinge edge of the door is provided with vertically spaced-apart metal strengthening plates embedded therein. The side jamb having the door hingedly secured thereto is also provided with a plurality of vertically spaced metal strengthening plates embedded therein. The strengthening plates are drilled and tapped to serve as a nut to receive machine screws securing the hinges which hingedly secure the door to the side jamb.

It is therefore a principal object of the invention to provide a unitary door frame.

Still another object of the invention is to provide a door frame comprised of first and second door frame members of unitary construction.

Still another object of the invention is to provide a door frame comprised of a fiberglass material and which does not have joints at the juncture between the side and head jambs therein which could harbor bacteria.

Still another object of the invention is to provide a door frame which may accommodate various wall thicknesses.

Still another object of the invention is to provide a door frame which is economical of manufacture, durable in use and refined in appearance.

Still another object of the invention is to provide a door frame which is comprised of strong side jambs, head jamb and connecting corners to facilitate the installation thereof and produce a strong and durable door frame.

Still another object of the invention is to provide a door frame in which the glass fiber reinforcement is continuous through the juncture of the head and side jambs, producing a door frame that is strong and dimensionally correct for receipt of the door and greatly ease the installation process.

Still another object of the invention is to provide a door frame including strengthening plates for securing hinges and other hardwares provided and which are totally enclosed in the reinforced fiberglass laminate during the molding process.

These and other objects will be apparent to those skilled in the art.

DESCRIPTION OF THE PREFERRED EMBODIMENT

Figure 1:
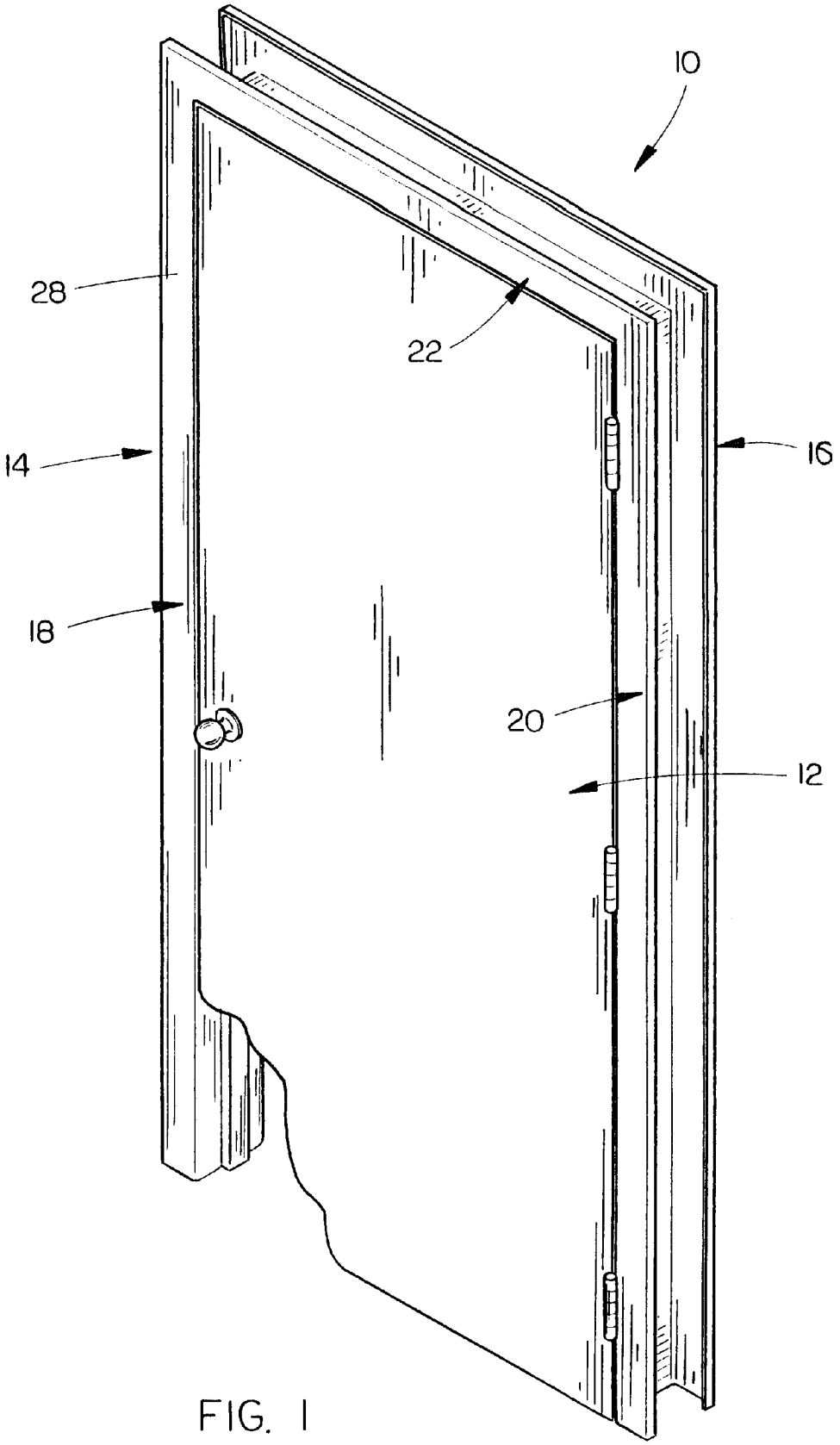
FIG. 1 is a perspective view of the door frame of this invention having a door hung therein.

The door frame assembly of this invention is referred to by the reference numeral 10 and is designed to have a door 12 pre-hung therein. Door frame assembly 10 includes door frame members 14 and 16.

Door frame member 14 is of unitary construction and includes side jambs 18 and 20 having a head jamb 22 extending between the upper ends thereof. Side jamb 18 is normally referred to as a latch jamb while side jamb 20 is normally referred to as a hinge jamb.

Figure 3:
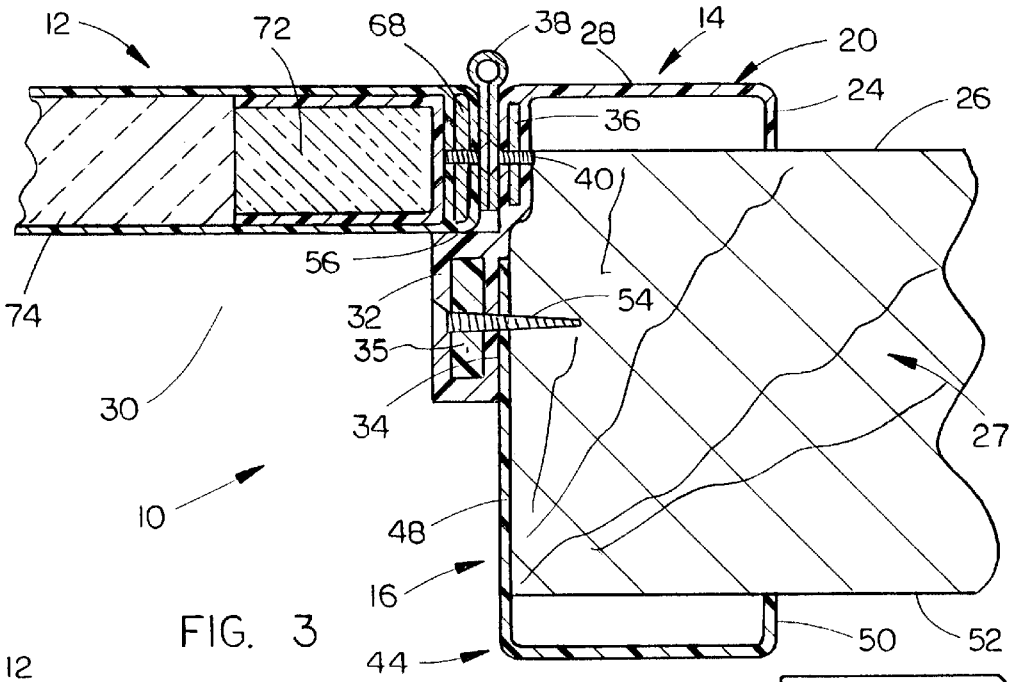
FIG. 3 is a partial sectional view of the door frame of this invention installed in a door opening.

Side jambs 18 and 20 and the head jamb 22 are provided with an inwardly extending lip 24 which is designed to engage the wall surface 26 of wall 27 which surrounds the door opening 30 created in the wall 27. The side jambs 18 and 20 and the head jamb 22 also include a trim section 28 which is positioned adjacent wall surface 26 to cover any gap between the door opening and the door frame. Each of the side jambs 18 and 20 and the head jamb 22 are also provided with an inside section 32 which extends substantially perpendicularly from trim section 28 and which extends into the door opening, as seen in FIG. 3. Inside section 32 is provided with a recessed area referred to generally by the reference numeral 34 which is positioned adjacent wall 26, as seen in FIG. 3. Inside section 32 is provided with a plurality of vertically spaced-apart reinforcing or support plates 35 embedded therein. Side jamb 20 is provided with a plurality of vertically spaced-apart metal reinforcing or support plates 36 encased therein for supporting the hinges 38 operatively secured thereto by machine screws 40. The plates 36 are tapped and drilled to enable the machine screws 40 to be threadably secured thereto.

Door frame member 16 is of unitary construction and includes side jambs 42 and 44 and head jamb 46 extending therebetween. As seen in the drawings, the side jambs 42 and 44 and the head jamb 46 are of unitary fiberglass construction. Door frame member 16 includes a trim section 46, inside section 48 and lip 50, as seen in the drawings. As seen in the drawings, lip 50 engages wall surface 52 of wall 28 and trim section 46 extends substantially parallel to the surface 52 of wall 28. Inside section 48 extends substantially perpendicularly from trim section 46 and is received in the recessed portion 34 of the door frame member 14. The door frame members 14 and 16 are secured together by means of adhesive applied in the recess 34 and the screws 54 extending through inside sections 32 and 48, as best illustrated in FIG. 3. It should be noted that if the door opening is larger than that required by the door, inside section 48 and inside section 32 may be spaced inwardly from wall 27 by inserting a spacer or spacers between section 32, 48 and the wall 27 with structural foam being injected into the remaining cavity. As also best illustrated in FIG. 3, inside section 32 of door frame member 14 is thickened to provide a door stop member referred to generally by the reference numeral 56.

Figure 5:
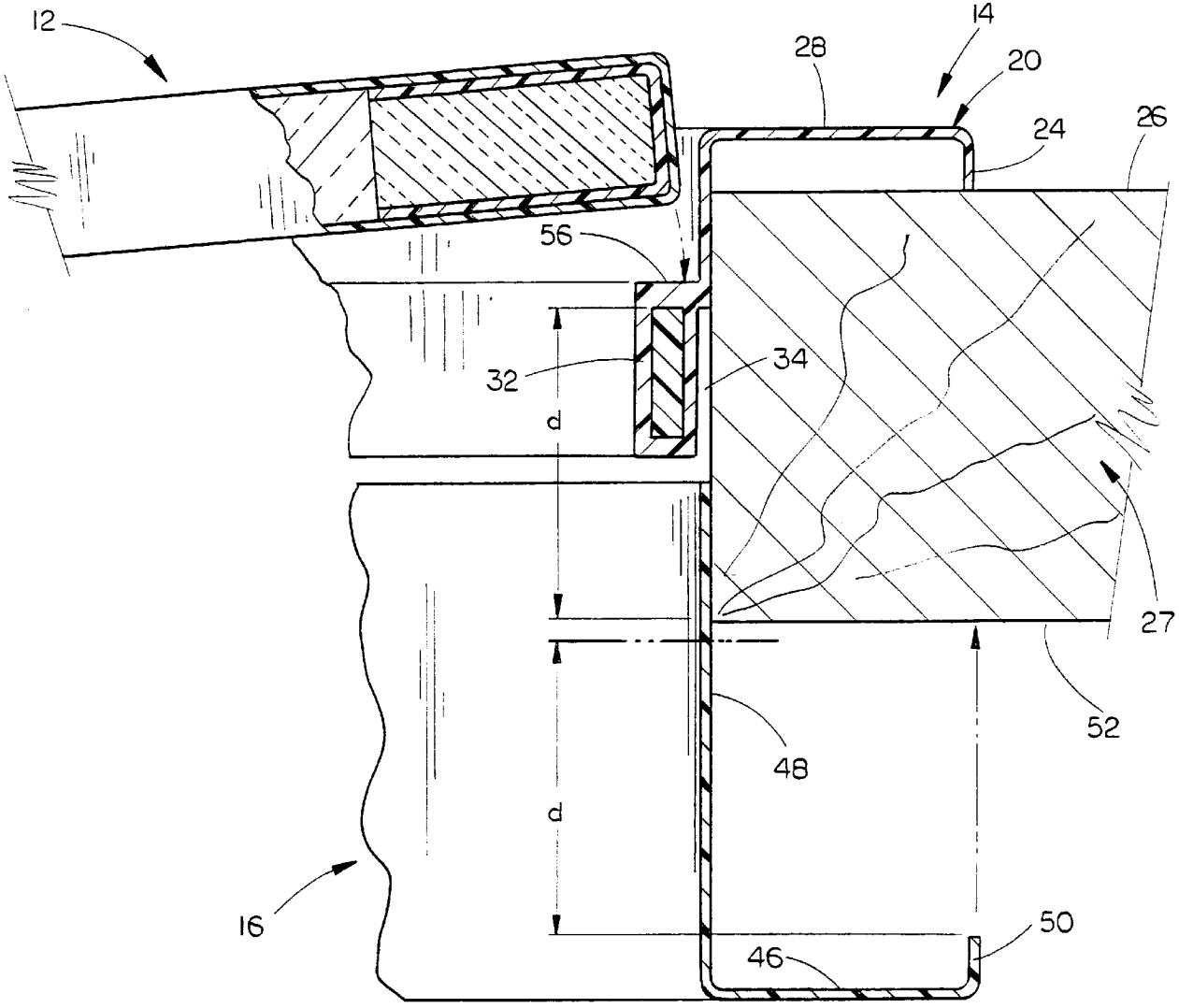
FIG. 5 is a partial sectional view illustrating how the door frame of this invention may accommodate walls having various thicknesses.

FIG. 5 illustrates the manner in which door frame member 16 may be trimmed so that the door frame 10 can be fitted to walls having various thicknesses. As seen, the installer determines the distance "d" from the inner end of recess 34 to the exterior surface of wall 52. The installer then measures that distance "d" from the inner end of lip 50 inwardly along trim section 48. The remaining portion of trim section 48 is then removed with the trimmed portion then being received within the recess 34 to provide the fit illustrated in FIG. 3.

Figure 4:
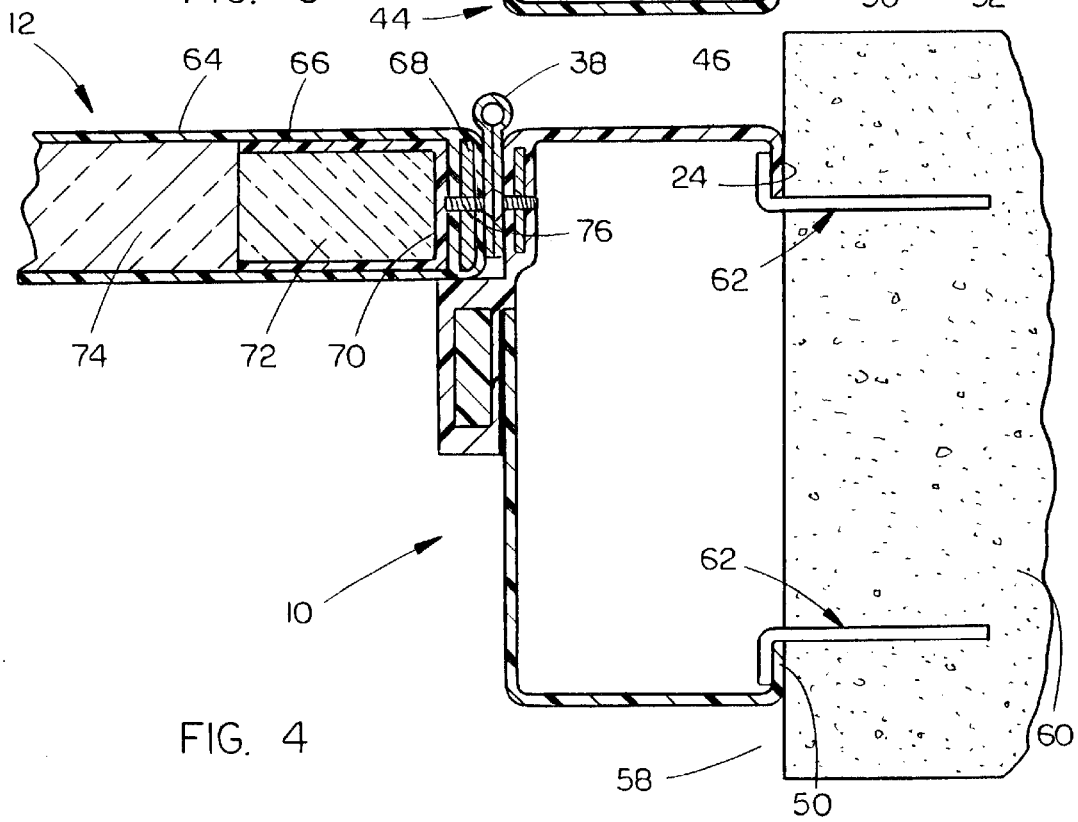
FIG. 4 is a partial sectional view of a modified form of the invention.

FIG. 4 illustrates the manner in which the door frame 10 may be installed in an opening 58 formed in a concrete wall 60. A plurality of L-shaped plates 62 are installed in the concrete wall in the manner illustrated in FIG. 4. The lips 24 and 50 on the door frame members 14 and 16 are then positioned with respect to the plate 62, as illustrated in FIG. 4, so that the door frame will be positioned in the opening. Heavy gage wire clips could also be used in place of plates 62. T-shaped metal plates could also be partially embedded in the wall 60 if desired. In the embodiment of FIG. 4, door frame members 14 and 16 are joined together at the factory with epoxy adhesive to form a single unitary door frame prior to shipment.

The door frame members 14 and 16 are preferably constructed of a fiber reinforced plastic. Preferably, the fibers are glass fibers. Door frame member 14 is formed by providing a closed mold having the glass fibers and the steel plates 36 placed therein and then injecting the resin into the mold to form a unitary fiber reinforced door frame member. Door frame member 16 is formed in the same manner except for the lack of steel reinforcing plates.

Figure 2:
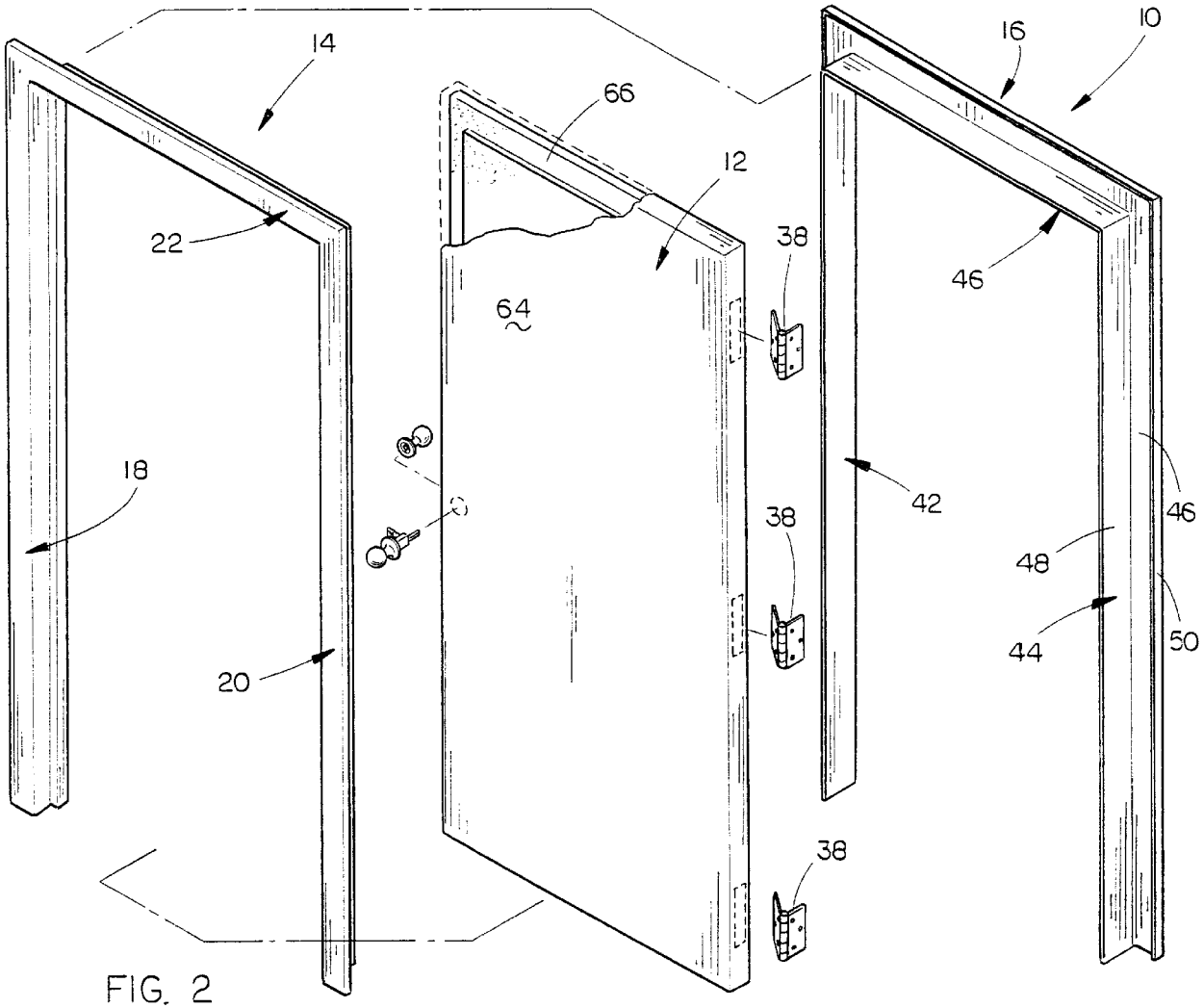
FIG. 2 is an exploded perspective view of the door frame of FIG. 1 with portions thereof cut away to more fully illustrate the invention.

Door 12 is provided with an outer skin or shell 64 of fiberglass construction. A U-shaped channel 66 of fiberglass construction is positioned in the door around the periphery thereof, as illustrated in FIGS. 2–4. A plurality of vertically spaced-apart metal plates 68 are positioned in the channel 66 as seen in the drawings. The numeral 70 refers to glass reinforcement fibers which are injected with the resin at the same time as the skin to integrally encase the metal backing plates 68 in the fiberglass laminate for additional strength. The area inside channel 66 is filled with a high density foam 72 while the remaining interior of the door 12 is filled with a low density foam material 74. The door 12 is secured to the hinges 38 by screws 76 extending through the hinge side of the door 12, through the metal reinforcing plates 68 and through the fiberglass reinforcement 70 encasing the metal plates 68.

Thus it can be seen that a novel door frame of fiber reinforced plastic (fiberglass) construction has been provided wherein there are no joints which could harbor bacteria or the like. It can also be seen that the door frame of this invention permits the door frame to accommodate various wall thicknesses by simply trimming the inside section of door frame member 16. The door frame of this invention is durable as well as refined in appearance.

It is believed that the door itself is also unique in its construction. The two densities of foam core provide an exceptionally strong door in areas where hardware and other items can be attached and where the door edge itself is likely to experience abuse. The center core, which is also strong, is of lower density to reduce the overall weight of the door. One method of making the core is to form a large block of low density foam and then place the low density block in a mold which is larger than the low density block and inject high density foam in the cavity around the low density foam. The resultant structure may then be sliced much like bread or a jelly roll with a filled center, with the slice being used as the core material.

Another way to fabricate the door is to put separate sections in the mold of the right thicknesses, which allows the fabricator to vary the thicknesses of the reinforcement at the edges or add additional reinforcement at the joint between the two types of foam. When the door is completed, it is a single one-piece seamless unit with exceptional strength that can be made with fire-resistant and ballistic-resistant materials as well as standard resin and glass reinforcement fibers.

Thus it can be seen that the invention accomplishes at least all of its stated objectives.

I claim:

1. A door frame, comprising:

a latch jamb having upper and lower ends;

a hinge jamb having upper and lower ends;

and a head jamb extending between the upper ends of said latch and hinge jambs;

said latch jamb, hinge jamb and head jamb being of unitary seamless construction so that a joint is not present between said latch jamb and said head jamb and so that a joint is not present between said hinge jamb and said head jamb.

2. The door frame of claim 1 wherein said latch jamb, hinge jamb and head jamb are comprised of a fiber reinforced plastic material.

3. The door frame of claim 1 wherein said latch jamb, hinge jamb and head jamb are comprised of a molded fiberglass material.

4. The door frame of claim 1 wherein at least said latch jamb and said head jamb have a door stop element integrally formed therewith.

5. The door frame of claim 1 wherein said latch jamb, hinge jamb and head jamb are comprised of a molded, pressure-injected fiberglass material.

6. The door frame of claim 3 wherein said fiberglass material is molded in a pressure-injected mold so that the glass fibers strengthen and reinforce the area between said latch jamb, hinge jamb and head jamb.

7. A door frame, comprising:

a first door frame member including a first side jamb having upper and lower ends, a second side jamb having upper and lower ends, and a first head jamb extending between the upper ends of said first and second side jambs, said first door frame member including a trim section for overlying a first wall surface adjacent a door opening in a wall and further including an inside section extending substantially perpendicularly from said trim section for extending into the opening;

a second door frame member including a first side jamb having upper and lower ends, a second side jamb, and a first head jamb extending between said upper ends of said first side jamb and said second side jamb of said second door frame member;

said second door frame member including a trim section for overlying a second wall surface adjacent the door opening and further including an inside section extending substantially perpendicularly from said trim section for extending into the doorway opening;

said first door frame member being of unitary construction;

said second door frame member being of unitary construction;

said inside sections of said first and second door frame members overlapping one another.

8. A door frame, comprising:

first door frame member including a first side jamb having upper and lower ends, a second side jamb having upper and lower ends, and a first head jamb extending between the upper ends of said first and second side jambs, said first door frame member including a trim section for overlying a first wall surface adjacent a door opening in a wall and further including an inside section extending substantially perpendicularly from said trim section for extending into the opening;

a second door frame member including a first side jamb having upper and lower ends, a second side jamb, and a first head jamb extending between said upper ends of said first side jamb and said second side jamb of said second door frame member;

said second door frame member including a trim section for overlying a second wall surface adjacent the door opening and further including an inside section extending substantially perpendicularly from said trim section for extending into the doorway opening;

said first door frame member being of unitary construction;

said second door frame member being of unitary construction;

said inside sections of said first and second door frame members overlapping one another;

one of said first side jambs having a strengthening means embedded therein for supporting a plurality of hinge members secured thereto.

9. The structure of claim 8 wherein each of said first and second door frame members are comprised of a fiber reinforced plastic material.

10. The structure of claim 8 wherein each of said first and second door frame members are comprised of a molded fiberglass material.

11. The structure of claim 8 wherein one of said first and second door frame members has a door stop element integrally formed therewith.

12. The structure of claim 8 wherein one of said inside sections of said first and second door frame members has a recessed portion formed therein for receiving the said inside section of the other of said first and second door frame members.

13. The door frame of claim 12 further including means securing said inside sections to one another.

14. The door frame of claim 12 wherein said recessed portion adjustably receives the other said inside section therein.

15. The door frame of claim 8 wherein one of said first and second door frame members has a door stop member integrally formed therewith.

16. The door frame of claim 8 wherein said strengthening means comprises a plurality of vertically spaced-apart metal plates embedded in said one first side jamb.

17. The door frame of claim 8 wherein a door member is hingedly secured to one of said side jambs of said door frame members.

18. A door frame, comprising:

a latch jamb having upper and lower ends;

a hinge jamb having upper and lower ends;

and a head jamb extending between the upper ends of said latch and hinge jambs;

said latch jamb, hinge jamb and head jamb being of unitary seamless construction so that a joint is not present between said latch jamb and said head jamb and so that a joint is not present between said hinge jamb and said head jamb;

said door being comprised of an outer fiberglass skin having an interior compartment filled with a foam material, said foam material including an outer peripheral member and an inner member, said outer peripheral member being comprised of a high density foam material, said inner member being comprised of a low density foam material;

said door including a hinge side edge and a latch side edge and wherein a plurality of vertically spaced strengthening plates are encased in said door frame inwardly of said hinge side edge and further wherein a plurality of vertically spaced hinge members are secured to said plurality of strengthening plates.

19. The door frame of claim 18 wherein said strengthening plates are drilled and tapped to receive screws and wherein said hinge members are secured to said strengthening plates by said screws.

* * * * *